US011304583B2

(12) United States Patent
Whittington

(10) Patent No.: US 11,304,583 B2
(45) Date of Patent: Apr. 19, 2022

(54) JOIST AND BASEBOARD APPARATUS

(71) Applicant: Lynda Lee Whittington, Plano, TX (US)

(72) Inventor: Lynda Lee Whittington, Plano, TX (US)

( * ) Notice: Subject to any disclaimer, the term of this patent is extended or adjusted under 35 U.S.C. 154(b) by 134 days.

(21) Appl. No.: 16/511,259

(22) Filed: Jul. 15, 2019

(65) Prior Publication Data

US 2021/0015332 A1 Jan. 21, 2021

(51) Int. Cl.

| | |
|---|---|
| ***A47L 13/16*** | (2006.01) |
| ***A47L 13/257*** | (2006.01) |
| ***A47L 13/258*** | (2006.01) |
| ***A47L 13/38*** | (2006.01) |
| ***A47L 13/254*** | (2006.01) |
| ***B05C 17/00*** | (2006.01) |

(52) U.S. Cl.

CPC ..... *A47L 13/16* (2013.01); *A47L 13/254* (2013.01); *A47L 13/257* (2013.01); *A47L 13/258* (2013.01); *A47L 13/38* (2013.01); *B05C 17/00* (2013.01)

(58) Field of Classification Search

CPC ..... A47L 13/16; A47L 13/146; A47L 13/20; A47L 13/254; A47L 13/255; A47L 13/257; A47L 13/258; A47L 13/38; B05C 17/00; B05C 17/10

See application file for complete search history.

(56) References Cited

U.S. PATENT DOCUMENTS

| | | | | | |
|---|---|---|---|---|---|
| 2,897,528 | A * | 8/1959 | Greenleaf | A47L 13/146 | 15/244.1 |
| 3,106,736 | A * | 10/1963 | Knapp | A47L 13/146 | 15/119.2 |
| 3,339,220 | A * | 9/1967 | Barry | A47L 13/24 | 15/233 |
| 3,760,450 | A * | 9/1973 | Griffin | A47L 13/255 | 15/229.6 |
| 5,131,111 | A * | 7/1992 | Richardson | A47L 13/146 | 15/119.1 |
| 5,267,369 | A * | 12/1993 | O'Neil | A46B 5/0025 | 15/160 |
| 6,591,442 | B2 * | 7/2003 | Kaminstein | A47L 13/20 | 15/228 |
| 8,464,389 | B2 * | 6/2013 | Jiang | A47L 13/12 | 15/118 |
| 8,640,296 | B2 * | 2/2014 | Weaver | A47L 13/256 | 15/231 |
| 2002/0174502 | A1 * | 11/2002 | Cioci | A47L 13/258 | 15/119.2 |
| 2009/0235476 | A1 * | 9/2009 | Cioci | A47L 13/12 | 15/118 |
| 2011/0191972 | A1 * | 8/2011 | Goodman | A47L 11/4036 | 15/210.1 |
| 2020/0009713 | A1 * | 1/2020 | Holmes | A47L 13/44 | |

* cited by examiner

*Primary Examiner* — Randall E Chin
(74) *Attorney, Agent, or Firm* — Baker Law Firm; John G. Baker

(57) ABSTRACT

A ceiling joist and panel grove cleaner apparatus, which provides a means for applying constant cleaning positioning pressure upon both ceiling joists edges and panel groves. The cleaner apparatus comprises a mop flat head applicator with a pivotable hinged application guide, a swivel mount, a handle, an interchangeable joist-cleaning pad, and, an interchangeable panel-grove cleaning pad.

4 Claims, 7 Drawing Sheets

121
120

119
112
113
118
116
114
104
120
121
108
100
106

112
113
118
119
116
114
104
108
100
106

JOIST AND BASEBOARD APPARATUS

FIELD OF THE INVENTION

The invention relates generally to apparatus for dusting, cleaning and coatings application.

BACKGROUND OF THE INVENTION

Various dusting tools for removing dust from ceiling joists are known in the art and typically include a feathered duster or the like mounted to a pole handle. A common problem encountered with the foregoing apparatus is the inability to apply even pressure to the surfaces to be cleaned, and the inadequate cleaning of corners.

It would be desirable to provide an apparatus adapted to clean ceiling joists that enables a user to apply even pressure along the length of the joist to ensure simultaneous thorough cleaning of both the joist leading edge and the joist side surfaces, including the corners where the joists and ceiling meet. After cleaning or painting both the joist leading edge and the joist side, one cleaning surface of a pair of cleaning surfaces of the apparatus can be rotated and snapped out of the way so now the opposite joist side can be cleaned or painted without having to paint or clean the joist leading edge again. An advantage here is that you do not have to take down the cleaning apparatus from the ceiling to the floor to remove one of two cleaning surfaces. To explain again, the apparatus can stay up in the air on the pole to clean both the leading edge of a joist and one joist side, then by gently knocking (pivoting and snapping into place) one of two cleaning surfaces somewhere on the ceiling out of the way, the other joist side may be cleaned without re cleaning the joist edge. This is a huge time saving advantage.

It is desirable if the foregoing apparatus were convertible to a baseboard cleaner capable of cleaning surfaces, including the corners where the baseboards and floor meet. It would be even more desirable if the foregoing apparatus can clean the surface area of the leading edge of the joist simultaneously with cleaning either side surface areas of the joist as well.

SUMMARY OF THE INVENTION

One general example implementation of a ceiling joist and baseboard cleaner includes an extendable handle mounted to a application face pivotable hinged application guide plate. The application face pivotable hinged application guide plate also termed "first hinged guide plate" and handle are connected by a swivel joint that may include a universal joint, a ball joint or any suitable coupling to permit swivel motion of the application face pivotable hinged application guide plate relative to the handle. The application face pivotable hinged application guide plate is hingeably connected to a pivotable hinged leading edge joist guide plate also termed "second hinged guide plate." Both the first hinged guide plate and the second hinged guide plate include a pad mounting surface. The apparatus includes one or more interchangeable pads that may include fine and course texture, fabric loops, etc., adapted for dust removal and the application of coatings such as polish, cleaners, stains and paint.

In a first aspect combinable with the general implementation, apparatus includes a hinge member, permitting the repositioning of the second hinged guide plate in relation to the first hinged guide plate.

In a second aspect combinable with any of the previous aspects, the apparatus has at least a first position wherein the pad mounting surfaces of the first hinged guide plate and second hinged guide plate are 90 degrees relative to one another.

In a third aspect combinable with any of the previous aspects, the apparatus has at least a second position wherein the pad mounting surfaces of the first hinged guide plate and second hinged guide plate are 180 degrees from one another.

In a fourth aspect combinable with any of the previous aspects, the apparatus has at least a second position wherein the pad mounting surfaces of the first hinged guide plate and second hinged guide plate are 270 degrees from one another.

In a fifth aspect combinable with any of the previous aspects, pads may be secured to the pad mounting surfaces by hook and loop fasteners, clamp fasteners, light tack adhesives or any other suitable attachment means that would suggest itself to those having skill in the art.

In a sixth aspect combinable with any of the previous aspects, the swivel typo joint may be a ball and socket joint that permits the first hinged guide plate to swivel in multiple directions.

In a seventh aspect combinable with any of the previous aspects, the swivel typo joint may be a universal yoke coupling that permits the first hinged guide plate to swivel in multiple directions.

In an eighth aspect combinable with any of the previous aspects, at least two sides of the first hinged guide plate are substantially parallel to at least two sides of second hinged guide plate.

In a ninth aspect combinable with any of the previous aspects, the first hinged guide plate and second hinged guide plates are joined by a hinge member along adjacent sides.

In a tenth aspect combinable with any of the previous aspects, a hinge member joining the first hinged guide plate and second hinged guide plates may be tensionable such that the plates may be maintained in a desired position in relation to one another.

In an eleventh aspect combinable with any of the previous aspects, the hinge member may include a ratcheting type hinge that may be set at at least two positions.

In a twelfth aspect combinable with any of the previous aspects, the hinge member and the swivel joint include a tensioning element for increasing or decreasing the hinge/joint resistance to movement.

In a thirteenth aspect combinable with any of the previous aspects, the extendable handle may be a telescoping pole construction.

In a fourteenth aspect combinable with any of the previous aspects, an interchangeable pad may be a single pad adapted to fold lengthwise when the first and pivotable hinged leading edge joist guide plates are repositioned, or two separate pads, each pad mounted to a separate plate.

These general and specific aspects may be implemented using a device, system or method, or any combinations of devices, systems, or methods. The details of one or more implementations are set forth in the accompanying drawings and the description. Other features, objects, and advantages will be apparent from the description and drawings, and from the claims.

BRIEF DESCRIPTION OF THE DRAWING FIGURES

REFERENCE LISTING OF THE NUMBERED ELEMENTS

Figure 1:
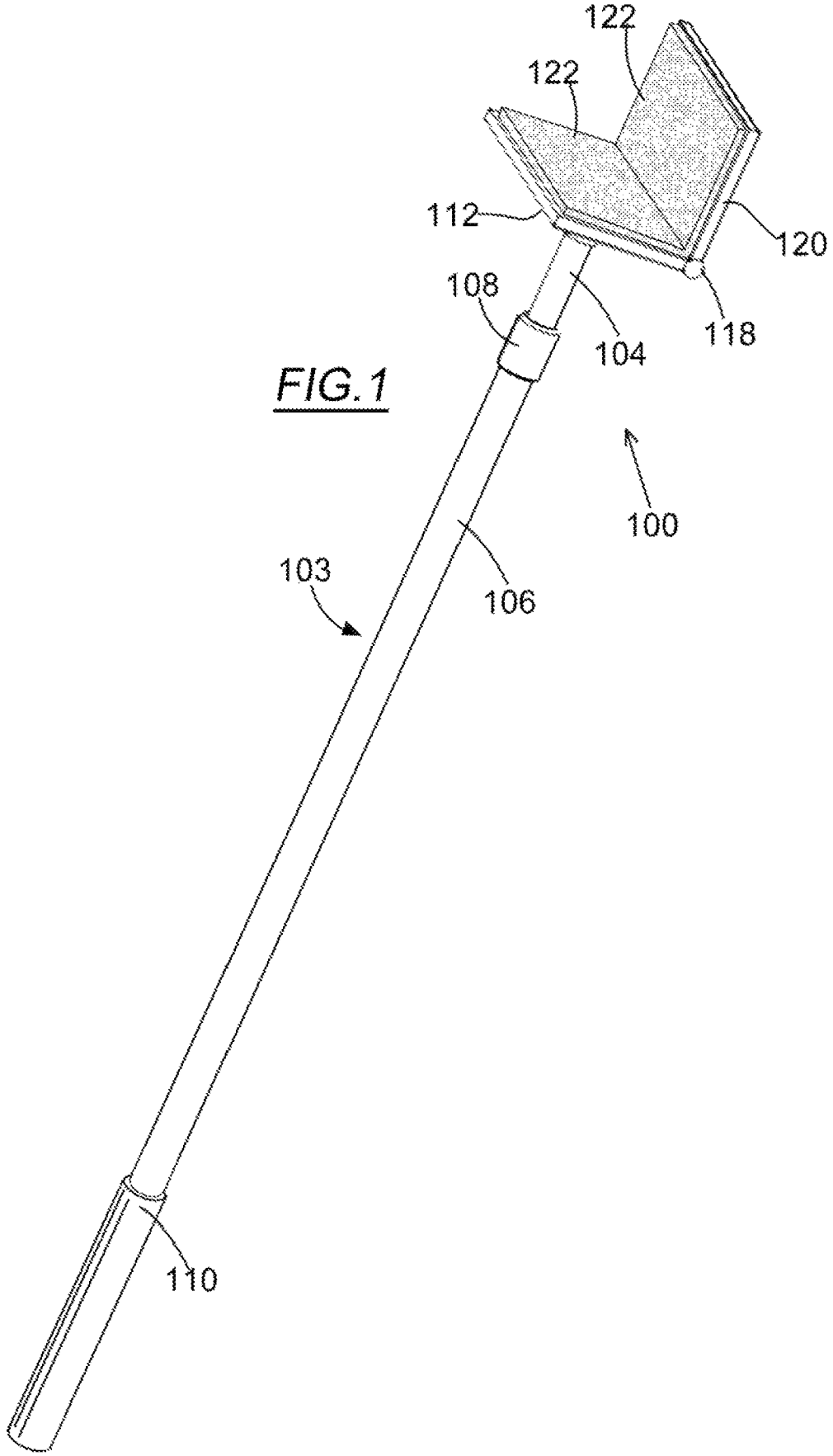
FIG. 1 is a perspective view of an example embodiment according to the present invention.

100 joist and baseboard apparatus
103 telescoping handle
104 inner pole member
106 outer pole member
108 pole lock
110 grip
112 application face pivotable hinged application guide plate
113 pad mounting surface
114 swivel joint
116 swivel joint mount
117 swivel tensioner
118 hinge member
119 hinge tensioner
120 pivotable hinged leading edge joist guide plate
121 pad mounting surface
122 flexible pad
124 pad attachment member
128 swivel joint stiffener
200 joist/beam
202 baseboard

Definitions

The term "comprises" means "includes." The term "pad" means any soft applicator, whether of natural material or synthetic that is capable of attracting and retaining dust, or, applying a coating to a surface. The term "coating" or "coatings" means any fluid material that may be a cleaning compound, a polish, a sealer, a stain or paint. The term "swivel" means pivoting and multi-axis movement. The term "joist" means a beam that may be abutting a surface or a stand alone beam in either a decorative or actual supportive capacity. The term "pad mounting surface" refers to the side of the plates configured to receive and retain a pad. The term "hinge member" means a hinge that permits pivotable movement within limits and may include a ratcheting type hinge similar to Model HG-RCT12-C available from Sugatsune America, Inc 18101 Savarona Way, Carson, Calif. 90746, that requires sufficient force to be applied in order to transition the hinge member from one discrete angular position to another, or Constant Torque Position Control Hinge similar to class E6/ST available from Southco® Inc., 210 North Brinton Lake Road, Concordville, Pa. 19331-0116, or tensionable piano type hinges that may have an adjustable end cap for increasing or decreasing the resistance to movement. Although methods and materials similar or equivalent to those described herein can be used in the practice or testing of this disclosure, suitable methods and materials are described below. It should be understood that the objects, features and aspects of any implementation or embodiment disclosed herein may be combined with any object, feature or aspect of any other implementation/embodiment without departing from the scope of the invention.

DETAILED DESCRIPTION OF THE EMBODIMENTS

Referring generally to FIGS. 1-8, an apparatus (100) configured for the cleaning of joists (200) and baseboards (202) includes an extendable handle (103) joined to a first hinged guide plate (112) by a swivel joint (114), and, a second hinged guide plate (120) joined to the first hinged guide plate (112) such that the first hinged guide plate and second hinged guide plate are moveable in relation to one another. The first hinged guide plate and second hinged guide plates are pivotable via the swivel joint. A hinge member (118) joining the plates (112, 120) and the swivel joint (114) are tensionable, typically by adjusting hinge tensioner (119) which may be a screw or knob that causes an internal element of the hinge tensioner to bear against the internal surfaces of the respective components. Each plate includes a pad mounting surface (113, 121) configured to accept and retain a flexible pad (122) that may be specialized for dusting, or coatings application.

FIG. 1 shows the entire apparatus with telescoping handle that includes inner (104) and outer (106) pole members and their relationship to the first hinged guide plate (112) and second hinged guide plate (120).

Figure 2:
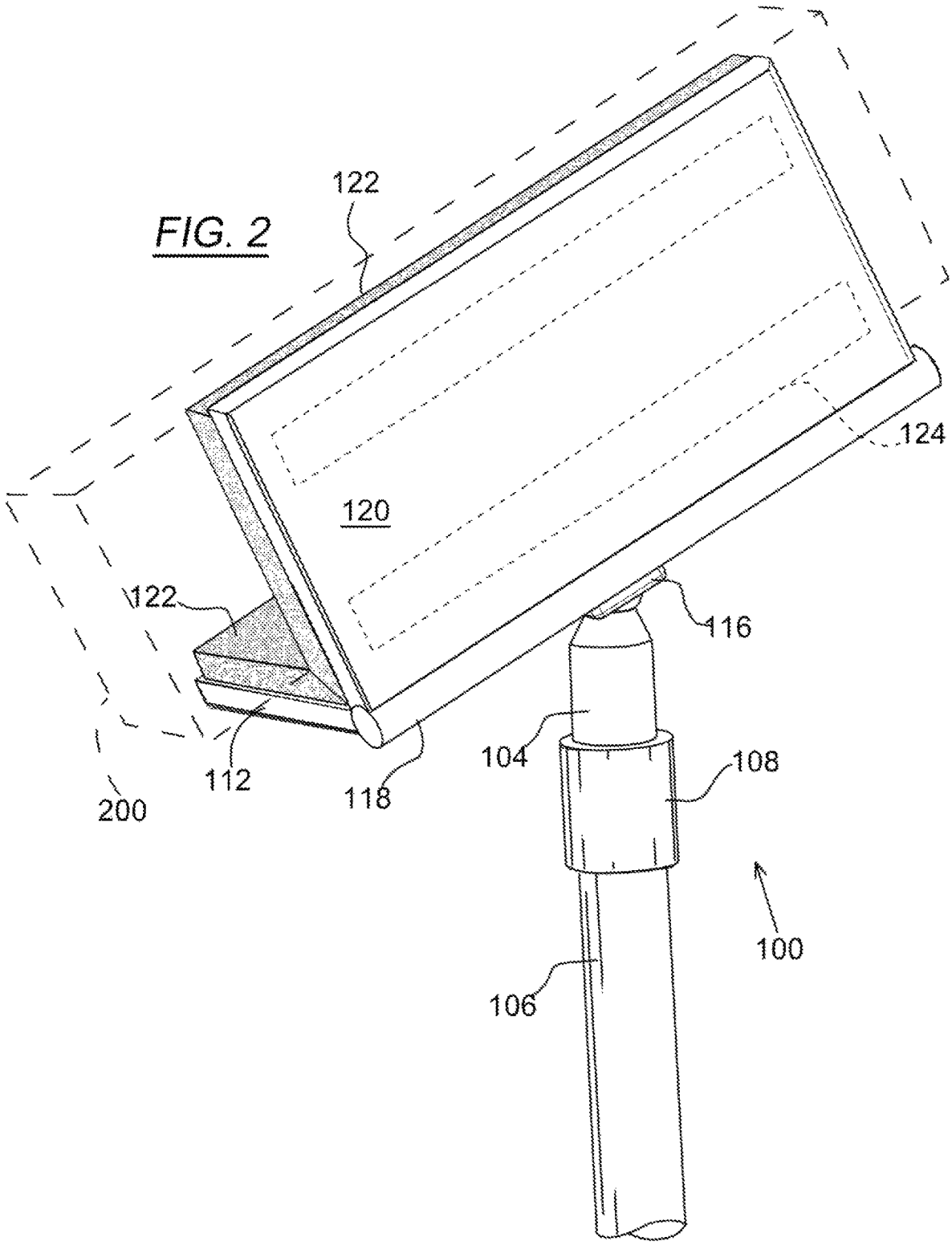
FIG. 2 is a perspective view of one end of the example embodiment in (FIG. 1)

FIG. 2 is a partial perspective view showing a handle portion with pole lock (108) that may be twisted to maintain the poles in a desired telescoped position, and the first and second guide plates in a position suitable for cleaning a joist (200) wherein the pad mounting surfaces (113, 121) of the plates (112, 120) are generally 90 degrees apart. Dashed line (124) represents an example hook and loop fastener adapted to attach to a corresponding fastener on a flexible pad (122). Other suitable securing methods for attaching the pads will be appreciated by those having skill in the art. Pads (122) may be interchanged and may include a number of textures, materials and other features for specialized cleaning or coating applications.

Figures 3, 4:
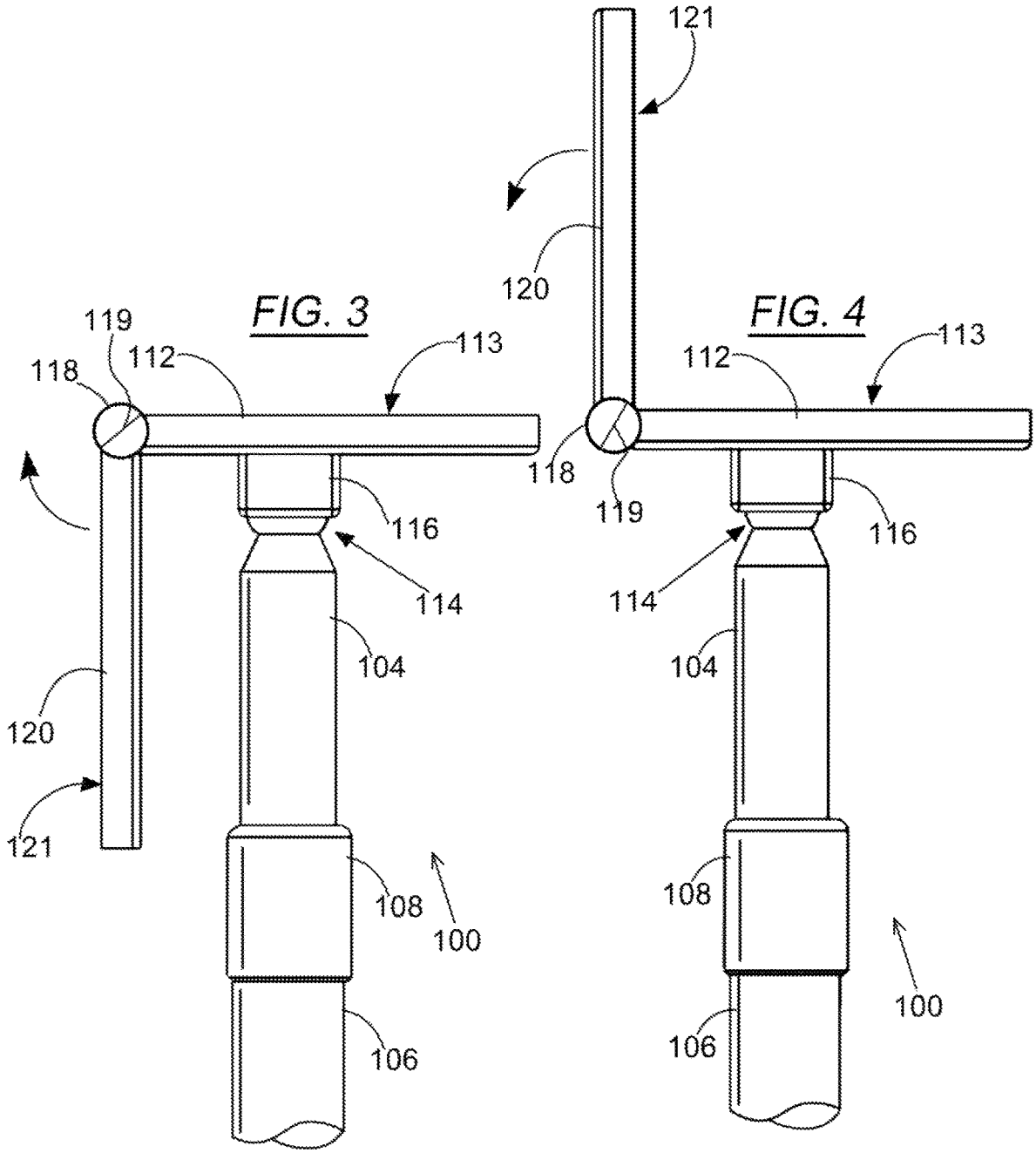
FIG. 3 is a side elevation thereof.
FIG. 4 is a side elevation thereof showing translation of a pivoting plate of (FIG. 3)

FIGS. 3 and 4 are partial side elevations showing two possible positions of the first hinged guide plate (112) and second hinged guide plate (120).

Figure 5:
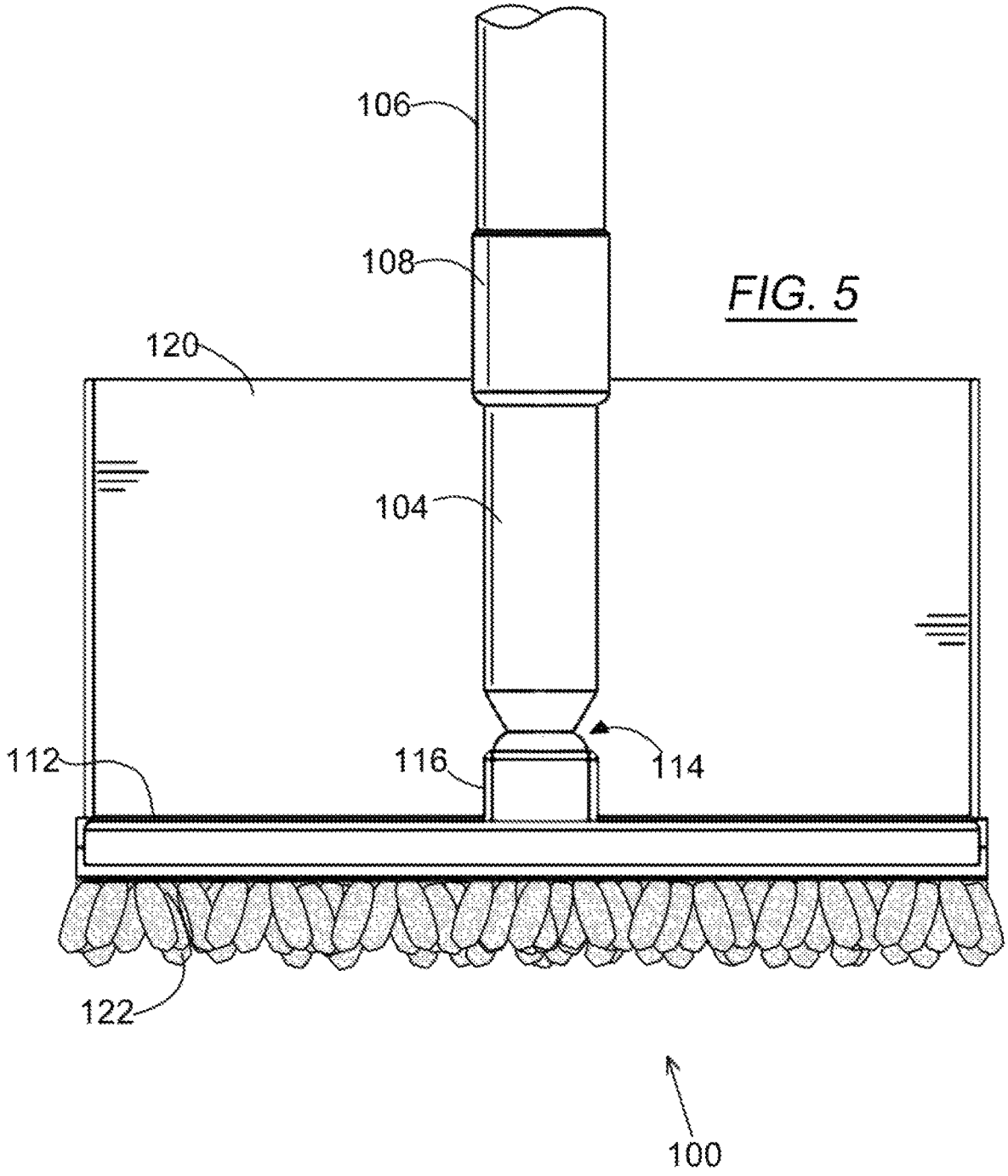
FIG. 5 is another side elevation thereof.

FIG. 5 is a partial side elevation showing the swivel joint (114) that joins the handle (103) to the first hinged guide plate (112). In the illustration, the mounting surfaces of the first hinged guide plate and second hinged guide plates are 270 degrees apart. Flexible pad (122) includes a looped construction.

Figure 6:
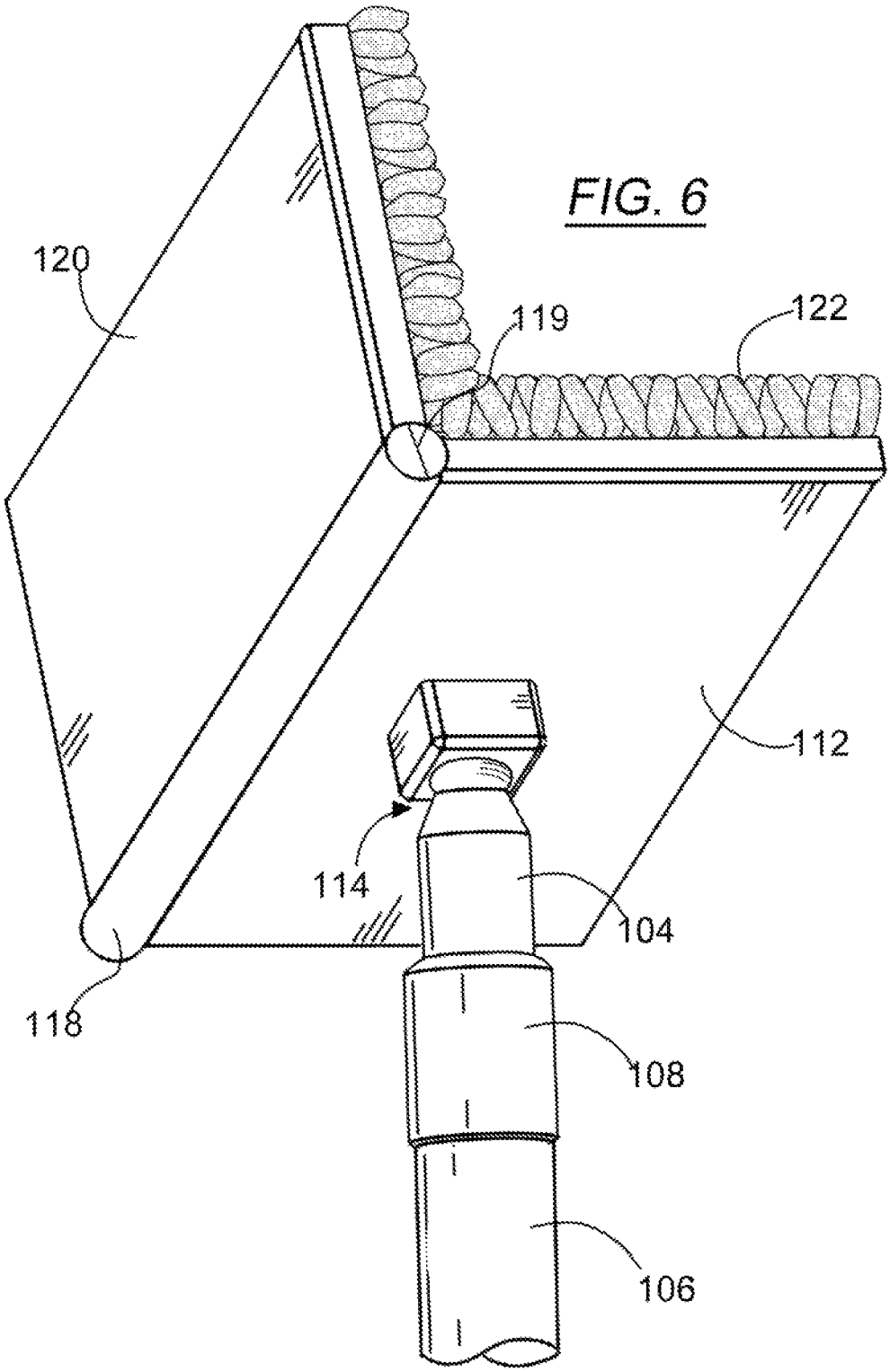
FIG. 6 is a perspective view thereof showing a joist cleaning configuration.

FIG. 6 is a partial perspective view showing apparatus (100) in a joist-cleaning configuration where the mounting surfaces of the first hinged guide plate and second hinged guide plate are 90 degrees apart, and further depicts the swivel joint (114) connecting inner pole (104) to the first hinged guide plate (112).

Figure 7:
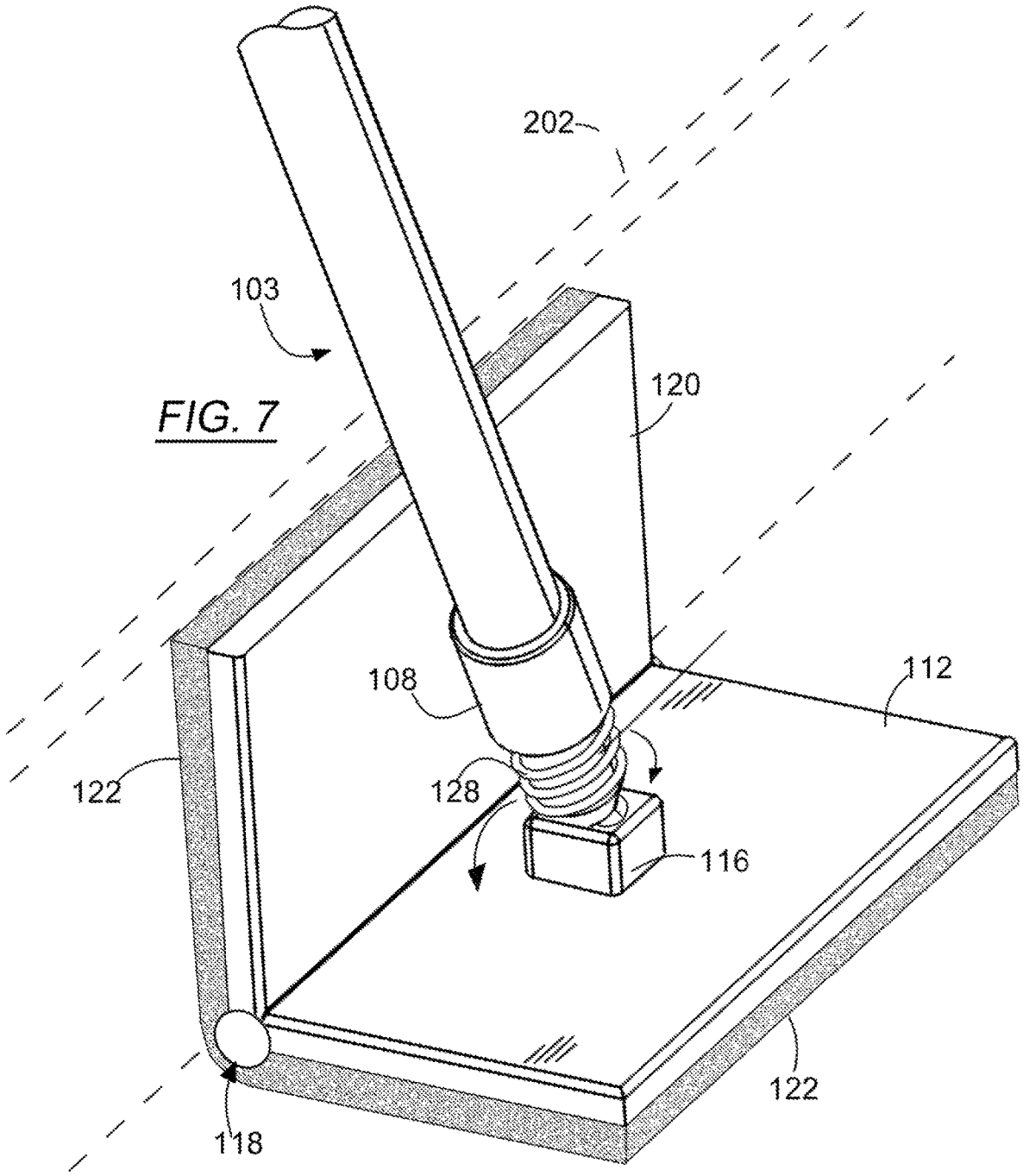
FIG. 7 is a perspective view thereof showing a baseboard cleaning configuration.

FIG. 7 is a partial perspective view showing apparatus (100) in a baseboard cleaning configuration, and further depicts swivel joint stiffener (128) that may take the form of a coil spring circumjacent the swivel joint (114) and between pole lock (108) and swivel joint mount (116).

Figure 8:
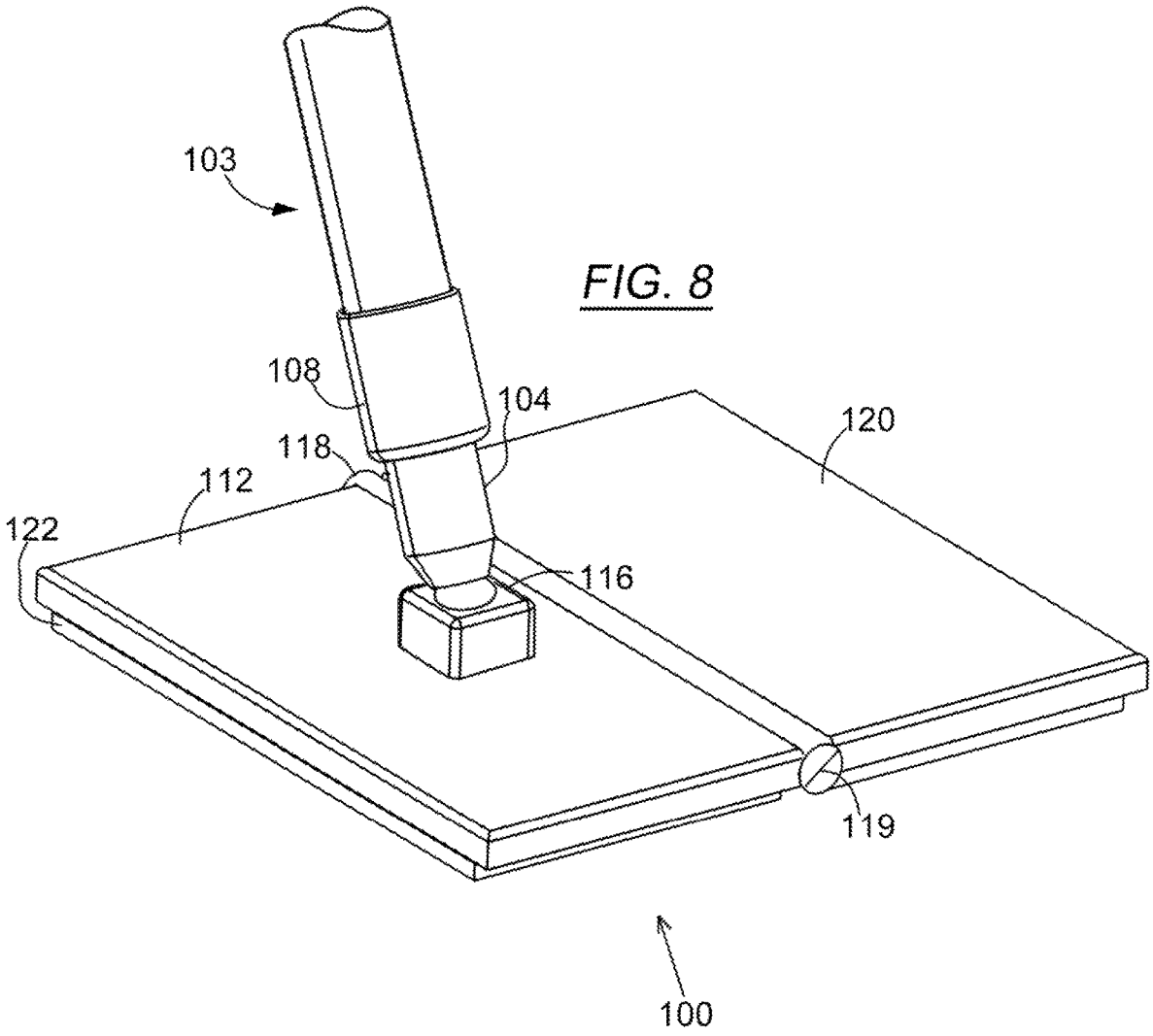
FIG. 8 shows the apparatus configured for a flat surface.

FIG. 8 is a partial perspective view showing apparatus (100) in a flat surface cleaning configuration where the pad mounting surfaces are 180 degrees apart.

What is claimed is:

1. A joist and baseboard apparatus comprising:

a handle assembly with a first end and a second end, the first end terminating with a swivelable joint;

a plate assembly including: a first guide plate connected to the swivelable joint and a second guide plate hingeably joined to the first guide plate;

one or more pad members including attachment sides and cleaning sides, the one or more cleaning pad members attachable to the first and second guide plates via the attachment sides;

the cleaning sides are securable in at least the following discrete positions: 90 degrees relative of one another, co-planar relative to one another, and 270 degrees relative to one another.

2. The joist and baseboard apparatus according to claim 1, the swivelable joint is tensionable.

3. The joist and baseboard apparatus according to claim 1, the one or more pad members configured to clean surfaces or apply a coating to a surface.

4. The joist and baseboard apparatus according to claim 1, the handle assembly configured to telescope.

* * * * *